US007563549B2

(12) United States Patent
Wu et al.

(10) Patent No.: US 7,563,549 B2
(45) Date of Patent: Jul. 21, 2009

(54) IMAGING MEMBER

(75) Inventors: Jin Wu, Webster, NY (US); Yuhua Tong, Webster, NY (US); Jennifer Y. Hwang, Penfield, NY (US); Liang-bih Lin, Rochester, NY (US); Andronique Ioannidis, Webster, NY (US); Nancy L. Belknap, Rochester, NY (US); Timothy J. O'Brien, Rochester, NY (US); Anthony Uttaro, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 11/133,979

(22) Filed: May 20, 2005

(65) Prior Publication Data

US 2006/0263708 A1 Nov. 23, 2006

(51) Int. Cl.
*G03G 5/14* (2006.01)

(52) U.S. Cl. ..... 430/60; 430/63; 430/123.43; 430/131

(58) Field of Classification Search ..... 430/60, 430/64, 65, 133, 123.4, 123.43, 131
See application file for complete search history.

(56) References Cited

U.S. PATENT DOCUMENTS

| | | | | |
|---|---|---|---|---|
| 3,121,006 | A | 2/1964 | Middleton et al. | |
| 3,590,000 | A | 6/1971 | Palermiti et al. | |
| 3,849,182 | A | 11/1974 | Hagenbach | |
| 3,900,588 | A | 8/1975 | Fisher | |
| 4,264,672 | A | 4/1981 | Taylor-Brown et al. | |
| 4,265,990 | A | 5/1981 | Stolka et al. | |
| 4,298,697 | A | 11/1981 | Baczek et al. | |
| 4,338,390 | A | 7/1982 | Lu | |
| 4,464,450 | A | 8/1984 | Teuscher | |
| 4,535,045 | A * | 8/1985 | Kawamura et al. | 430/60 |
| 4,558,108 | A | 12/1985 | Alexandru et al. | |
| 4,560,535 | A | 12/1985 | Bouchee | |
| 4,560,635 | A | 12/1985 | Hoffend et al. | |
| 4,921,769 | A | 5/1990 | Yuh et al. | |
| 5,385,796 | A | 1/1995 | Spiewak et al. | |
| 5,449,573 | A * | 9/1995 | Aoki et al. | 430/131 |
| 6,132,912 | A | 10/2000 | Fuller et al. | |
| 7,018,758 | B2 * | 3/2006 | Tong et al. | 430/64 |
| 7,125,634 | B2 * | 10/2006 | Tong et al. | 430/60 |
| 7,135,261 | B2 * | 11/2006 | Yamazaki | 430/59.2 |
| 2004/0202947 | A1 | 10/2004 | Wu et al. | |

OTHER PUBLICATIONS

Diamond, A.S., ed., *Handbook of Imaging Materials*, Marcel Dekker, NY (1991), pp. 160, 161, 395, and 396.*

S-LEC-B polyvinylbutyrals in S-LEC B and K Table of products, solubility, and chemical properties [online]. Sekisui Chemicals Co., Ltd., specialty chemicals, copyright 2002 [retrieved on Dec. 19, 2007]. Retrieved from Internet: < URL: http://i-front.sekisui.copj/cs/eng/html/slecbk/b-10.html.*

American Chemical Society (ACS) File Registry No. 546-68-9 on STN, copyright 2007.*

* cited by examiner

*Primary Examiner*—Janis L Dote
(74) *Attorney, Agent, or Firm*—Eugene O. Palazzo; Fay Sharpe LLP

(57) ABSTRACT

Provided is an imaging member comprising a substrate, an undercoat layer (UCL), a charge generation layer, a charge transport layer, and an optional overcoat layer. The undercoat layer is formed from a single-phase UCL coating formulation comprising an organic titanate, a polymer containing active hydrogen, and an aminosilane. The UCL formulation has improved properties such as stability, processing convenience, and longer pot life etc. The UCL formulation can be used to manufacture an imaging member such as photoreceptor with improved properties such as stable, thick UCL coating, resistance to electrical failure, and PIDC independency on UCL thickness etc.

16 Claims, 1 Drawing Sheet

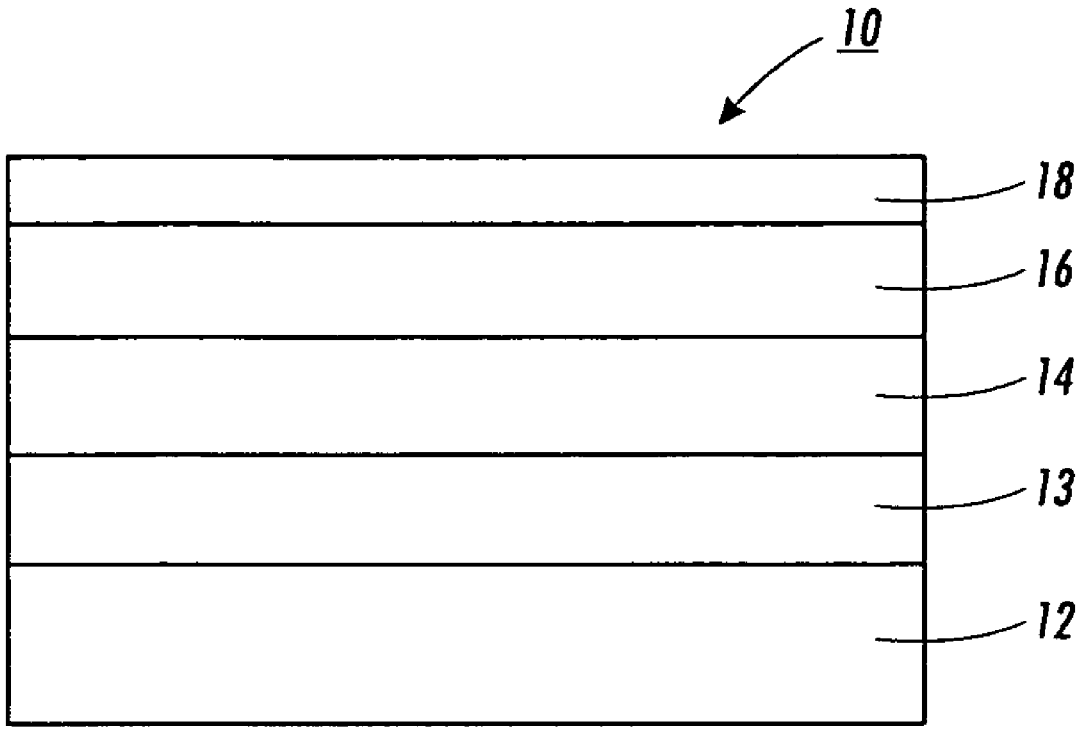
10
18
16
14
13
12

IMAGING MEMBER

BACKGROUND

The present disclosure is generally directed, in various embodiments, to imaging members. More particularly, the disclosure relates to various embodiments of an imaging member comprising a substrate, an undercoat layer (UCL), a charge generation layer, a charge transport layer, and an optional overcoat layer. The undercoat layer is formed from a single phase UCL formulation comprising an organic titanate, a polymer containing active hydrogen, and an aminosilane.

Most of the undercoat layers (UCL) on the market are particulates with metal oxides dispersed in polymeric matrices. For example, United States Patent Application Publication No. 2004/0202947, the contents of which are incorporated entirely herein by reference, has disclosed that an UCL coating dispersion was prepared by ball milling of titanium dioxide and phenolic resin in 1-butanol and xylene with 1-millimeter diameter sized $ZrO_2$ beads for 5 days. The resulting titanium dioxide dispersion was then filtered with a 20-micrometer pore size nylon cloth. Additional solvent, bisphenol S (4,4'-sulfonyldiphenol), and tetraethoxysilane (TEOS) were then added to the dispersion. An aluminum pipe was dip coated with the coating dispersion, and subsequently cured at 160° C. for 15 minutes, resulting in an undercoat layer (UCL) of 2.5~5 microns thickness.

However, the preparation of the UCL dispersion is typically a complicated process including milling, and the resulting dispersion sometimes has a pot life issue since metal oxides tend to be precipitate out from the organic polymeric solution. Meanwhile, internal cyclic life associated with the dispersed UCL sometimes is not good enough due to the limitations of electron transport of metal oxides and inhomogeneity of the UCL. Furthermore, thick UCL demanded for long operational life.

As such, new UCL formulations with improved properties such as stability, processing convenience, longer internal cyclic life, and longer pot life etc. are needed. Also needed are imaging members such as photoreceptor that has stable, thick UCL coating; resistance to electrical failure; and PIDC independency on UCL thickness etc., among others.

REFERENCES

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of disclosed photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is substantially incapable of transporting for any significant distance injected charge carriers generated by the photoconductive particles.

In U.S. Pat. No. 4,921,769, the disclosure of which is totally incorporated herein by reference, there is illustrated photoconductive imaging members with blocking layers of certain polyurethanes.

Illustrated in U.S. Pat. No. 5,449,573, the disclosure of which is totally incorporated herein by reference, are undercoat layers containing γ-aminopropyltriethoxysilane (6.2 parts), tributoxyzirconium acetylacetonate (45.8 parts) and polyvinylbutyral (BMS, 3.2 parts) in 1-butanol (59.8 parts) as the solvent. The three-component undercoat layer usually requires humidification during the drying step and the dried layer thickness is limited from a practical perspective to, for example, about 1.5 microns for optimum performance.

In U.S. Pat. No. 5,385,796, the disclosure of which is totally incorporated herein by reference, poly (2-hydroxyethyl methacrylate) is disclosed for use in imaging members, and which members possess high dark decay and cyclic instability, disadvantages avoided or minimized with the members of the present disclosure.

There is disclosed in U.S. Pat. No. 4,464,450, the disclosure of which is totally incorporated herein by reference, developed thin coatings of gamma-aminopropyltriethoxysilane hydrolyzed with acetic acid to prevent low relative humidity cycle down in trigonal selenium photoreceptors.

Illustrated in U.S. Pat. No. 6,132,912, the disclosure of which is totally incorporated herein by reference, three different photoreceptor designs were investigated. In the first, a hydroxy containing polymer at 20 centipoise in ethanol was coated on a flexible titanized MYLAR® (polyethylene terephthalate) substrate, followed by a 49,000 adhesive layer, followed by a binder photogenerator layer, followed by a charge transport layer. In the second device, a layer of hydrolyzed γ-aminotriethoxysilane, reference U.S. Pat. No. 4,464,450, was coated on top of a hydroxy containing polymer layer, followed by an interfacial adhesive layer, followed by a binder-photogenerator layer, and as the top layer the charge transport layer. The third photoreceptor design contained a mixture of a hydroxy containing polymer and γ-aminopropyltriethoxysilane with acetic acid (0.3 gram of acetic acid per gram of γ-aminopropyltriethoxysilane), followed by an interfacial 49,000 adhesive layer, followed by a binder-photogenerator layer, and then followed by a charge transport layer.

BRIEF DESCRIPTION

In one exemplary embodiment, an imaging member is provided. The imaging member such as photoreceptor comprises a substrate, an undercoat layer (UCL), a charge generation layer, a charge transport layer, and an optional overcoat layer; and the undercoat layer is formed from a UCL formulation comprising an organic titanate, a polymer containing active hydrogen, and an aminosilane. When dissolved in a solvent, the UCL formulation and the solvent form a single phase.

In another exemplary embodiment, a method of preparing an imaging member such as photoreceptor is provided. The method comprises (i) providing a substrate, (ii) coating an undercoat layer (UCL) above the substrate, (iii) coating a charge generation layer (CGL) above the UCL, (iv) coating a charge transport layer (CTL) above the CGL, and (v) optionally coating an overcoat layer (OCL) above the CTL. The undercoat layer is formed from a UCL formulation comprising an organic titanate, a polymer containing active hydrogen, and an aminosilane. When dissolved in a solvent, the UCL formulation and the. solvent form a single-phase solution.

In another exemplary embodiment, a method of imaging is provided. The method comprises generating an electrostatic latent image on an imaging member, developing the latent image, and transferring the developed electrostatic image to a suitable substrate. The imaging member such as photoreceptor comprises a substrate, an undercoat layer (UCL), a charge generation layer, a charge transport layer, and an optional overcoat layer; and the undercoat layer is formed from a UCL formulation comprising an organic titanate, a polymer containing active hydrogen, and an aminosilane. When dissolved in a solvent, the UCL formulation and the solvent form a single phase.

These and other non-limiting embodiments will be more particularly described with regard to the drawings and detailed description set forth below.

BRIEF DESCRIPTION OF THE DRAWINGS

The following is a brief description of the drawings, which is presented for the purposes of illustrating the disclosure set forth herein and not for the purposes of limiting the same.

FIG. 1 shows a schematic cross-sectional view of a photoconductive imaging member in accordance with the present disclosure.

DETAILED DESCRIPTION

The present disclosure relates to a photoconductive imaging member comprising a substrate, an undercoat layer (UCL), a charge generation layer (CGL), a charge transport layer (CTL), and an optional overcoat layer (OCL) disposed over the charge transport layer. The undercoat layer is formed from a UCL formulation comprising an organic titanate, a polymer containing active hydrogen, and an aminosilane. When dissolved in a suitable solvent, the UCL formulation can form a single phase.

Also included within the scope of the present disclosure are methods of preparing the imaging member as described supra.

Further included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; and, 4,338,390, the disclosures of which are totally incorporated herein by reference, subsequently transferring the image to a suitable substrate, and permanently affixing the image thereto.

A more complete understanding of the processes and apparatuses disclosed herein can be obtained by reference to the accompanying drawings. These figures are merely schematic representations based on convenience and the ease of demonstrating the present development, and are, therefore, not intended to indicate relative size and dimensions of the imaging members or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

With reference to FIG. 1, a photoconductive imaging member in accordance with the present disclosure is shown. Photoconductive imaging member 10 comprises a substrate 12, an undercoat layer (UCL) 13, a charge generating or photogenerating layer 14, a charge transport layer 16, and an optional overcoat layer 18. The undercoat layer 13 is formed from a UCL formulation comprising an organic titanate, a polymer containing active hydrogen, and an aminosilane in accordance with the present disclosure. When dissolved in a suitable solvent, the UCL formulation can form a single phase.

It is to be understood herein, that if a "range" or "group" is mentioned with respect to a particular characteristic of the present disclosure, for example, percentage, chemical species, and temperature etc., it relates to and explicitly incorporates herein each and every specific member and combination of sub-ranges or sub-groups therein whatsoever. Thus, any specified range or group is to be understood as a shorthand way of referring to each and every member of a range or group individually as well as each and every possible sub-ranges or sub-groups encompassed therein; and similarly with respect to any sub-ranges or sub-groups therein.

In this regard, disclosed herein is a UCL formulation comprising an organic titanate, a polymer containing active hydrogen, and an aminosilane. When dissolved in a suitable solvent, the UCL formulation can form a single phase.

Any solvent that can effectively dissolve the organic titanate, the polymer containing active hydrogen, and the aminosilane may be employed to form the single-phase mixture such as a solution. Typical solvent according to the present disclosure comprises a ketone type solvent. Exemplary ketone type solvents include, but are not limited to, methyl isobutyl ketone (MIBK), acetone, methyl ethyl ketone, methyl propyl ketone, methyl isopropyl ketone, methyl butyl ketone, methyl amyl ketone, methyl isoamyl ketone, diethyl ketone, ethyl amyl ketone, dipropyl ketone, diisopropyl ketone, cyclohexanone, methylcylcohexanone, trimethylcyclohexanone, mesityl oxide, diisobutyl ketone, isophorone, and the like, and the mixture thereof.

Of course, other solvents or solvent mixtures are also contemplated within the scope of the present disclosure. Examples of such solvents include, but are not limited to, ether type solvents such as diethyl ether, tetrahydrofuran, diphenyl ether, anisole and dimethoxybenzene; alcohol type solvents such as methanol, ethanol, propanol, isopropanol, n-butyl alcohol and tert-butyl alcohol; nitrile type solvents such as acetonitrile, propionitrile and benzonitrile; ester type solvents such as ethyl acetate and butyl acetate; carbonate type solvents such as ethylene carbonate and propylene carbonate; halogenated hydrocarbon solvents such as methylene chloride, chloroform and chlorobenzene; hydrocarbon solvents such as hexane, benzene, xylene and toluene; and the like, and the mixture thereof.

In a specific embodiment, the solvent of the UCL formulation is methyl isobutyl ketone. If thicker UCL coating is desired, low boiler such as methyl ethyl ketone (MEK) may be used to replace methyl isobutyl ketone.

Generally, the amount of solvent used depends upon the type of coating technique employed to fabricate the photoconductive imaging member. For example, less solvent is used for dip or immersion coating than for extrusion coating.

Typically, the organic titanate may be any suitable chelated titanate known to a skilled artisan in the field, such as titanium acetylacetonates and triethanolamine titanates. Exemplary chelated titanates include, but are not limited to, the compounds having formulas as shown below:

(T1)
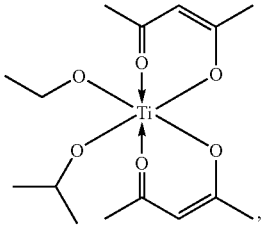
(T2)
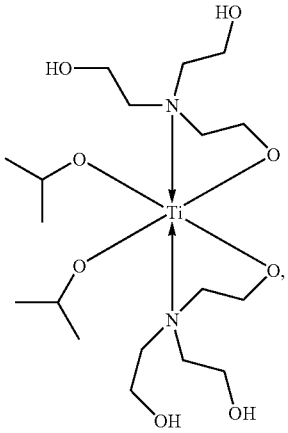
(T3)
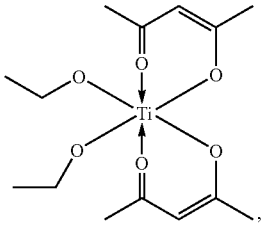
(T4)
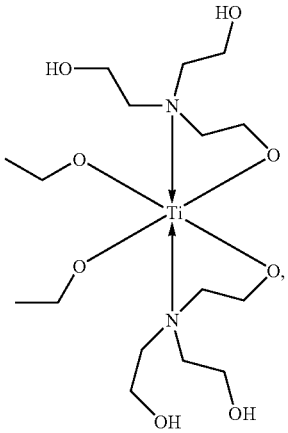
(T5)
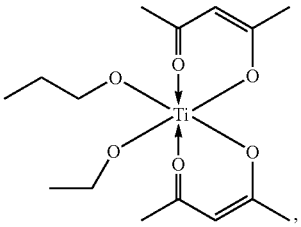
-continued
(T6)
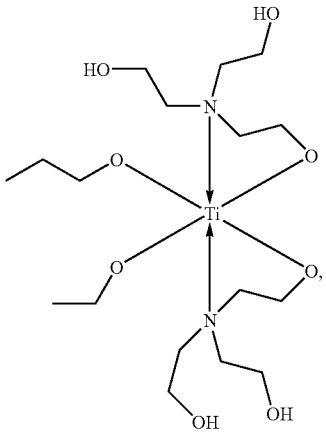
(T7)
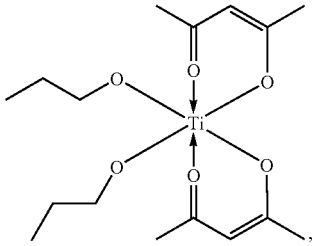
(T8)
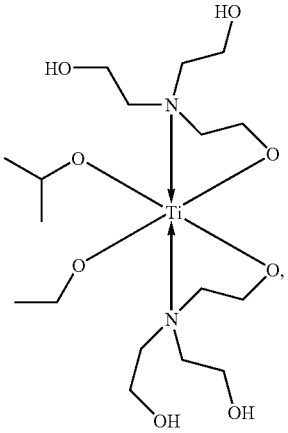
(T9)
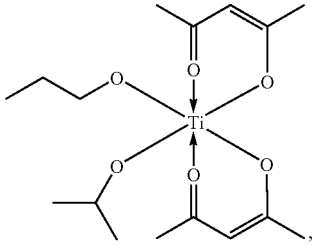

-continued
(T10)
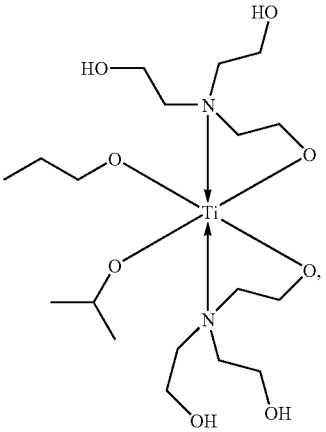
(T11)
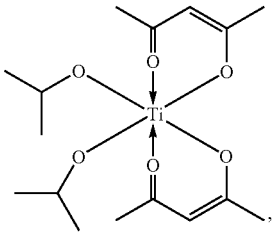
(T12)
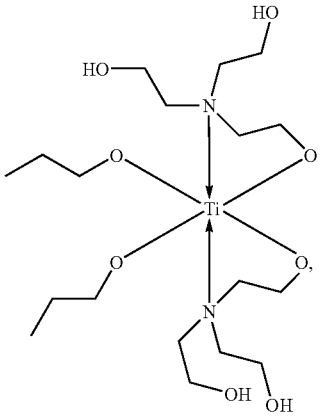
(T13)
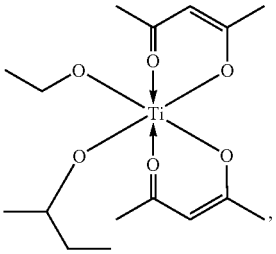
-continued
(T14)
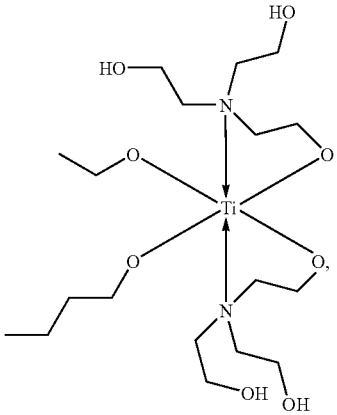
(T15)
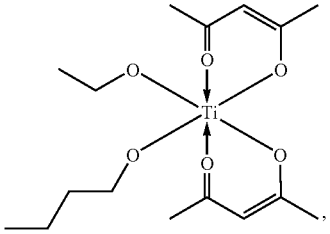
(T16)
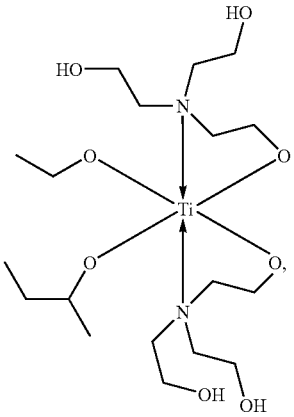
(T17)
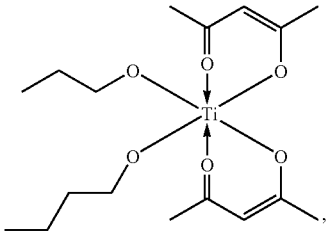

-continued
(T18)
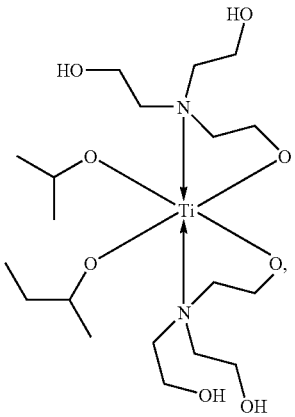
(T19)
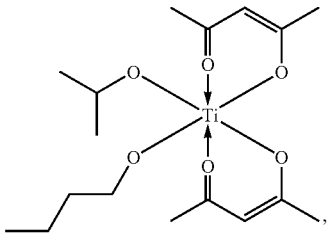
(T20)
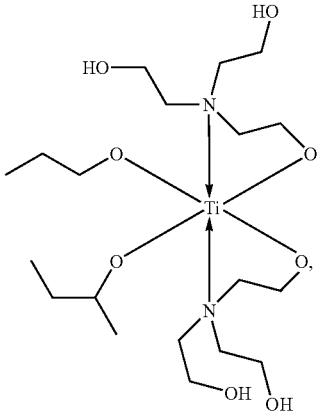
(T21)
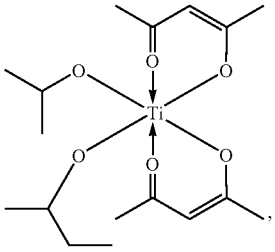
-continued
(T22)
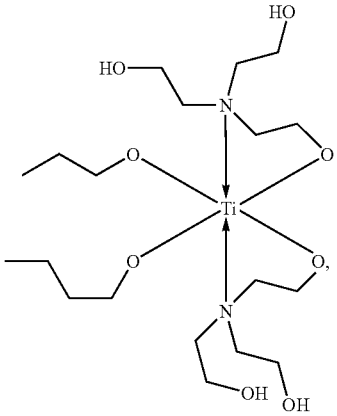
(T23)
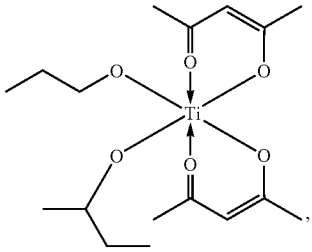
(T24)
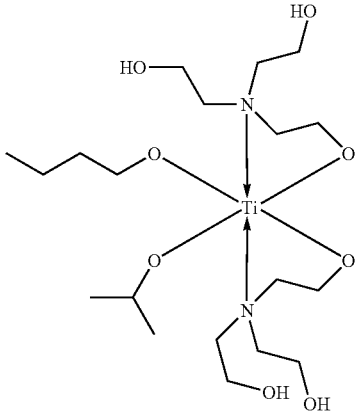
and the like, and the mixture thereof.
In a specific embodiment, the organic titanate of the UCL formulation is the compound with formula T1 as shown below:
(T1)
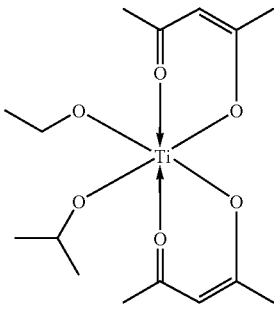

The organic titanates of the disclosure may be prepared by known methods in the field. Of course, they may also be obtained from commercial sources. For example, some of the organic titanates are available from DuPont under the trade name of TYZOR®, such as TYZOR AA series products and TYZOR TE series products. In a specific embodiment, TYZOR AA-105 is used as the organic titanate in the UCL formulation of the present disclosure.

Based on the total weight of the UCL formulation, the amount of the organic titanate present in the UCL formulation in accordance with the present disclosure is from about 80 to about 5 wt %, including from about 60 to about 20 wt %, and from about 50 to about 30 wt %. In a specific embodiment, the amount is 40 wt %.

Generally, the organic titanate cross-links the polymer containing active hydrogen through the active hydrogen, such as the hydrogen of hydroxyl, amino, amido, carboxyl and thio groups. In a variety of typical embodiments, the organic titanates are relatively more stable than tetraalkyl titanates upon hydrolysis. Such stability is beneficial to the pot life of the UCL formulation in solution.

As described supra, the present disclosure relates to a photoconductive imaging member comprising a substrate, an undercoat layer (UCL), a charge generation layer (CGL), a charge transport layer (CTL), and an optional overcoat layer (OCL) disposed over the charge transport layer. The undercoat layer is formed from a UCL formulation comprising an organic titanate, a polymer containing active hydrogen, and an aminosilane. When dissolved in a suitable solvent, the UCL formulation can form a single phase.

In a variety of exemplary embodiments, the polymer containing active hydrogen of the UCL formulation may be a polymer or copolymer that contains one or more of the following groups:

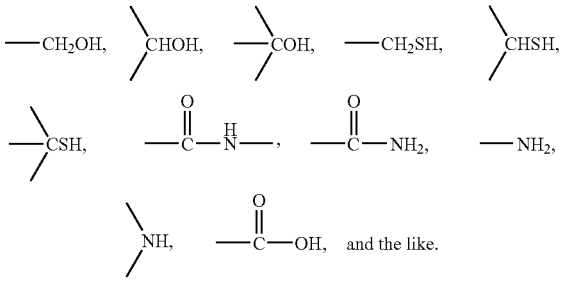

The polymer containing active hydrogen of the UCL formulation may comprise a poly (acrylic acid) or copolymer thereof, or a poly (methacrylic acid) or copolymer thereof. As a skilled artisan can understand, poly (acrylic acid) and poly (methacrylic acid) may be prepared by, for example, free radical polymerization.

The polymer containing active hydrogen of the UCL formulation may comprise a poly (vinyl alcohol) or copolymer thereof. In general, poly (vinyl alcohol) cannot be made directly because vinyl alcohol is the unstable enol form of acetaldehyde. As such, poly (vinyl alcohol) or copolymer thereof is synthesized by hydrolysis or alcoholysis of other polymers such as poly (vinyl acetate), as shown below:

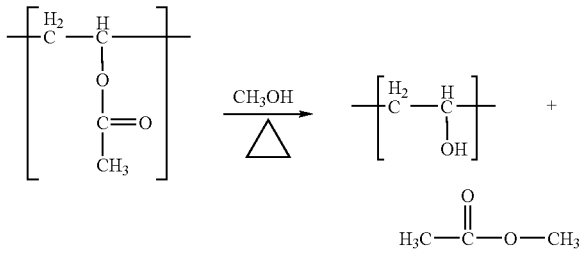

Other exemplary reactions that may be utilized to synthesize the polymer containing active hydrogen of the UCL formulation include, but are not limited to, the following reactions:

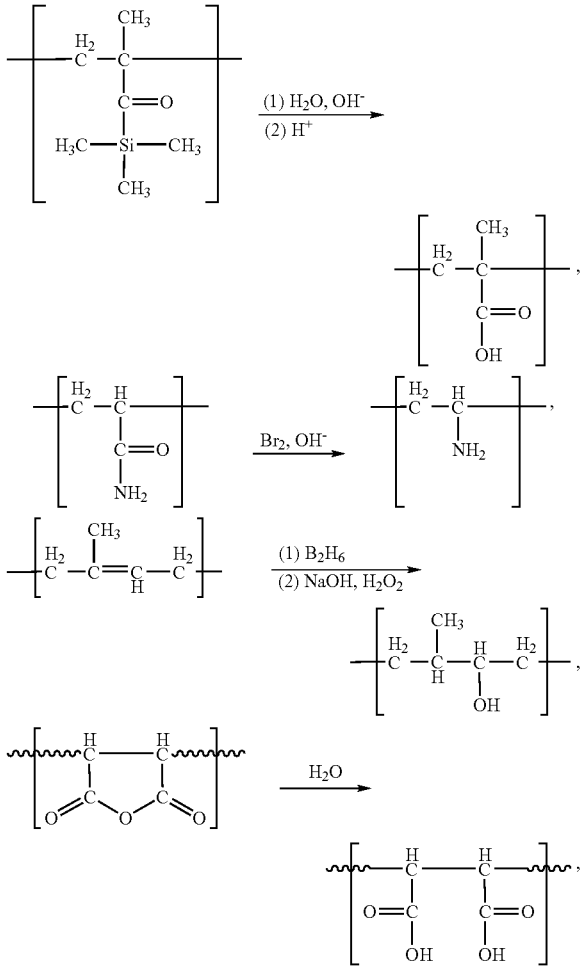

and the like.

In a variety of exemplary embodiments, the polymer containing active hydrogen may be a hydroxyl acrylate-containing polymer. Examples of hydroxy acrylate-containing polymers include poly (2-hydroxyethyl acrylate), poly (2-hydroxyethyl methacrylate), poly (3-hydroxypropyl acrylate), poly (3-hydroxypropyl methacrylate), poly (4-hydroxybutyl acrylate), poly (4-hydroxybutyl methacrylate), homopolymers, copolymers, terpolymers, mixtures thereof, and the like. The polymers can be typically prepared by the free radical polymerization of the corresponding monomer in various solvents principally alcohol or water. Representative references for the polymerizations are as follows: M. Macret and Gerald Hild, "Hydroxyalkyl methacrylates: kinetic investigations of radical polymerizations of pure 2-hydroxy methacrylate and 2,3-dihydroxypropyl methacrylate and the radical copolymerization of their mixtures", *Polymer,* 1982, 23, 81, and ibid, 748; O. Wichterle and R. J. Chromecek, *J. Polym. Sci.,* 1969, C16, 4677; R. J. Fort and T. M. Polyzoidis, *Eur. Polym. J.,* 1976, 12, 685; B. Carton, V. Bottiglione, M. Morcellet, and C. Loucheux, *Makromol. Chem.,* 1978, 179, 2931; D. E. Gregonis, G. A. Russell, J. D. Andrade, and A. C. deVisser, "Preparation and properties of stereoregular poly (hydroxyethylmethacrylate) polymers and hydrogels" *Polymer,* 1978, 19, 1279; and D. E. Gregonis, C. M. Chen, and J. D. Andrade, in "Hydrogels for Medical and Related Applications," ACS Symposium Series No. 31, Washington, D.C., 1976, p. 88, the disclosures of each of these publications being totally incorporated herein by reference.

For example, the polymer containing active hydrogen of the UCL formulation may comprise a polymeric film forming reaction product of at least vinyl chloride, vinyl acetate and hydroxyalkyl acrylate. The film-forming polymer is the reaction product of at least vinyl chloride, vinyl acetate and a hydroxyalkyl acrylate prepared using conventional emulsion or suspension polymerization techniques. The chain length can be controlled by varying the reaction temperature and time. One embodiment of the polymer may be formed from a reaction mixture comprising from about 80% to about 90% by weight vinyl chloride, from about 3% to about 15% by weight vinyl acetate and from about 6% to about 20% by weight hydroxyalkyl acrylate, based on the total weight of the reactants for the terpolymer. This terpolymer may be represented by the following formula:

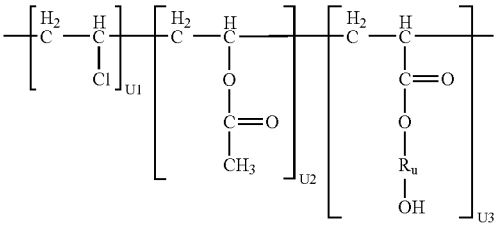

Wherein $R_u$ is an alkylene group such as ethylene or propylene; U1 is the proportion of the polymer derived from vinyl chloride that is from about 80% to about 90% by weight, based on the total weight of the reactants for the terpolymer; U2 is the proportion of the polymer derived from vinyl acetate that is from about 3% to about 15% by weight, based on the total weight of the reactants for the terpolymer; and U3 is the proportion of the polymer derived from hydroxyalkyl acrylate that is from about 6% to about 20% by weight, based on the total weight of the reactants for the terpolymer.

In a variety of exemplary embodiments, the polymer containing active hydrogen of the UCL formulation may comprise a polymeric film forming reaction product of at least vinyl chloride, vinyl acetate, hydroxyalkyl acrylate, and maleic acid. The film-forming polymer is the reaction product of at least vinyl chloride, vinyl acetate, a hydroxyalkyl acrylate, and maleic acid prepared using conventional emulsion or suspension polymerization techniques. One embodiment of the copolymer may be formed from a reaction mixture comprising from about 80% to about 90% by weight vinyl chloride, from about 3% to about 15% by weight vinyl acetate, from about 6% to about 20% by weight hydroxyalkyl acrylate, and from about 0.1% to about 0.5% by weight maleic acid, based on the total weight of the reactants for the tetrapolymer. This tetrapolymer may be represented by the following formula:

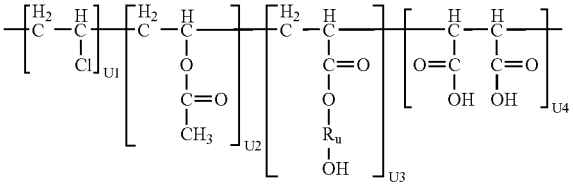

Wherein $R_u$ is an alkylene group such as ethylene or propylene; U1 is the proportion of the polymer derived from vinyl chloride that is from about 80% to about 90% by weight, based on the total weight of the reactants for the tetrapolymer; U2 is the proportion of the polymer derived from vinyl acetate that is from about 3% to about 15% by weight, based on the total weight of the reactants for the tetrapolymer; U3 is the proportion of the polymer derived from hydroxyalkyl acrylate that is from about 6% to about 20% by weight, based on the total weight of the reactants for the tetrapolymer; and U4 is the proportion of the polymer derived from maleic acid that is from about 0.1% to about 0.5% by weight, based on the total weight of the reactants for the tetrapolymer.

Similarly, the polymer containing active hydrogen of the UCL formulation may comprise a terpolymer of vinyl chloride, vinyl acetate and vinyl alcohol such as VAGH, available from Union Carbide.

In a specific embodiment, the polymer containing active hydrogen of the UCL formulation is a polymeric reaction product of 81% by weight vinyl chloride, 4% by weight vinyl acetate and 15% by weight hydroxyethyl acrylate (VAGF, available from Union Carbide). VAGF is a terpolymer having a weight average molecular weight of about 33,000.

In another specific embodiment, the polymer containing active hydrogen of the UCL formulation may be UCARMAG-527 available from Dow Chemical. UCARMAG-527 comprises a tetrapolymer reaction product of 81% by weight vinyl chloride, 4% by weight vinyl acetate, 0.28% by weight maleic acid and 15% by weight hydroxyethyl acrylate having a number average molecular weight ($M_n$) of about 35,000 and inherent viscosity 0.56.

In another specific embodiment, the polymer containing active hydrogen of the UCL formulation is poly(methyl methacrylate-co-2-hydroxyethyl methacrylate) synthesized by XRCC.

Based on the total weight of the UCL formulation, the amount of the polymer containing active hydrogen present in the UCL formulation in accordance with the present disclosure is from about 1 to about 50 wt %, including from about 5 to about 40 wt %, and from about 10 to about 30 wt %. In a specific embodiment, the amount is 20% (wt).

As described supra, the present disclosure relates to a photoconductive imaging member comprising a substrate, an undercoat layer (UCL), a charge generation layer (CGL), a charge transport layer (CTL), and an optional overcoat layer (OCL) disposed over the charge transport layer. The undercoat layer is formed from a UCL formulation comprising an organic titanate, a polymer containing active hydrogen, and an aminosilane. When dissolved in a suitable solvent, the UCL formulation can form a single phase.

By definition, the aminosilane of the present disclosure comprises at least two structural moieties. The first moiety is an amino group and the second moiety is a silane group selected from the group consisting of alkoxysilyl, arylalkoxysilyl, aryloxysilyl, alkylaryloxysilyl, and combination thereof.

In a variety of exemplary embodiments, aminosilane of the present disclosure may be selected from one or more of the following compounds:

G-1

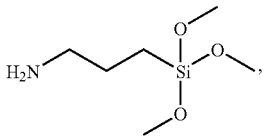

G-2

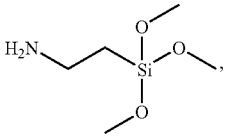

G-3

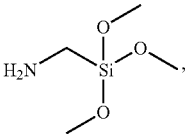

G-4

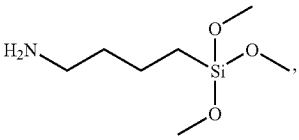

G-5

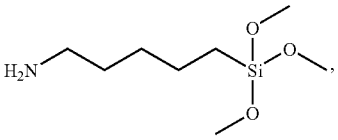

G-6

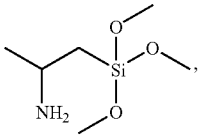

G-7

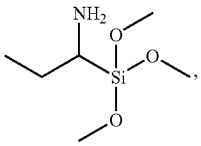

G-8

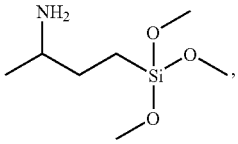

-continued

G-9

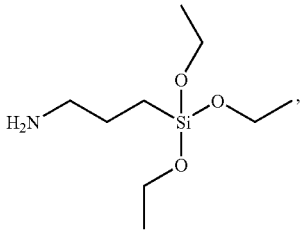

G-10

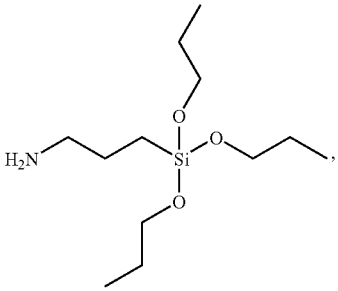

G-11

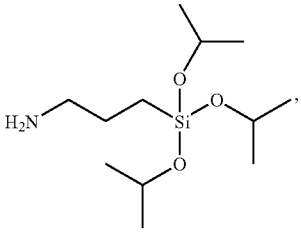

G-12

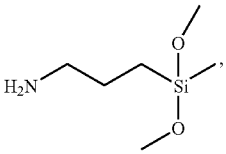

G-13

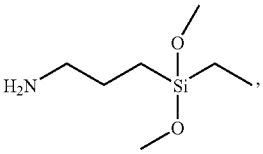

G-14

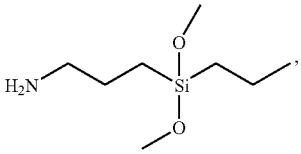

G-15

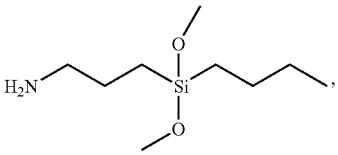

G-16

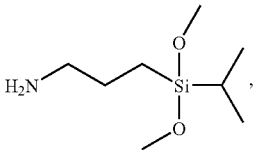

-continued

G-17

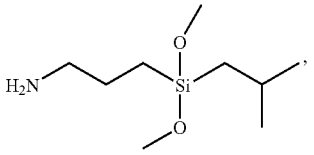

G-18

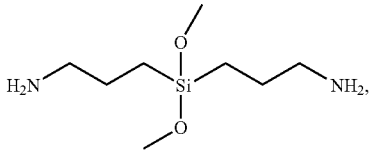

G-19

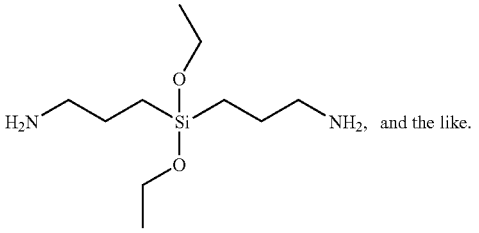

and the like.

In a specific embodiment, aminosilane of the UCL formulation is 3-aminopropyl trimethoxysilane (γ-APS) represented by formula G-1 as shown below:

G-1

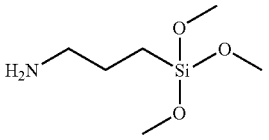

Based on the total weight of the UCL formulation, the amount of aminosilane present in the UCL formulation in accordance with the present disclosure is from about 80 to about 5 wt %, including from about 60 to about 20 wt %, and from about 50 to about 30 wt %. In a specific embodiment, the amount is 40% (wt).

As described supra, the present disclosure relates to a photoconductive imaging member comprising a substrate, an undercoat layer (UCL), a charge generation layer (CGL), a charge transport layer (CTL), and an optional overcoat layer (OCL) disposed over the charge transport layer. The undercoat layer is formed from a UCL formulation comprising an organic titanate, a polymer containing active hydrogen, and an aminosilane. When dissolved in a suitable solvent, the UCL formulation can form a single phase. Although any suitable method may be used to prepare the single phase UCL coating solution, typically the preparation is conducted as following. First, one can dissolve the polymer containing active hydrogen in solvent, then add and mix with the aminosilane, at last add and mix the organic titanate. Normally, a single phase UCL solution is a clear solution. In a specific embodiment, the single phase UCL solution was prepared by dissolving TYZOR AA-105/γ-APS/UCARMAG-527 with a weight ratio of 40/40/20 in methyl isobutyl ketone (MIBK). With the above addition order, a transparent (a little reddish) solution was obtained. The viscosity of the solution has been monitored with time and no pot life issue was observed, indicating good stability of the UCL formulation of the present disclosure.

When used in coating, the single phase UCL solution may be coated and cured at elevated temperature such as from about 120° C. to about 200° C., for a sufficient period of time such as from about 60 minutes to about 5 minutes. In a specific embodiment, conditions for the curing of the single phase UCL solution was 160° C. for 15 minutes. Typically, a transparent undercoat layer may be obtained from the procedure.

The single phase UCL formulation of the present disclosure exhibits numerous advantages. The formulation is easier to process and has a longer pot life than particulate dispersions. It can enable thicker UCL coatings such as greater than ~1 μm. The UCL coating is relatively stable upon hydrolysis. The formulation also performs very well electrically, for example, it can increase resistance to electrical failure during long machine operation. The full devices with the UCL have shown very decent PIDC characteristics that are not UCL thickness dependent. Moreover, the UCL formulation is versatile and can be used as a matrix to which charge transport materials, plywood suppression agents including IR absorbing dyes, amorphous silicone nitride, and others can be added, increasing the functionalities of the UCL.

The present disclosure also relates to a method of preparing an imaging member such as photoreceptor. The method comprises (i) providing a substrate, (ii) coating an undercoat layer (UCL) above the substrate, (iii) coating a charge generation layer (CGL) above the UCL, (iv) coating a charge transport layer (CTL) above the CGL, and (v) optionally coating an overcoat layer (OCL) above the CTL.

In the method of preparing imaging member, the undercoat layer is formed from a UCL formulation comprising an organic titanate, a polymer containing active hydrogen, and an aminosilane as described supra. When dissolved in a suitable solvent, the UCL formulation can form a single-phase solution.

An imaging member may be prepared by any suitable techniques that are well known in the art. A rigid or flexible substrate support layer may first be provided. The substrate support layer can be formed of a conductive material. Alternatively, a conductive layer can be formed on top of a non-conductive substrate support layer.

The charge generation layer is then applied to the electrically conductive surface. An undercoat layer (or charge blocking layer) may be applied to the electrically conductive surface prior to the application of the charge generation layer, for example, when an organic photoreceptor is to be fabricated. If desired, an adhesive layer may be utilized between the charge blocking layer and the charge generation layers. Usually the charge generation layer is applied onto the blocking layer and the charge transport layers of the present disclosure are formed on the charge generation layer. This structure may have the charge generation layer on top of or below the charge transport layers. For example, a charge generation layer may be sandwiched between conductive surface and charge transport layer; or a charge transport layer may be sandwiched between a conductive surface and a charge generation layer. This structure may be imaged in the conventional xerographic manner, which usually includes charging, optical exposure and development.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like, which are flexible as thin webs. An electrically conducting substrate may be any metal, for example, aluminum, nickel, steel, copper, and the like; or a polymeric material, as described above, filled with an electrically conducting substance, such as carbon, metallic powder, and the like; or an organic electrically conducting material. The electrically insulating or conductive substrate may be in the form of an endless flexible belt, a web, a rigid cylinder, a sheet, and the like.

The thickness of the substrate layer depends on numerous factors, including strength desired and economical considerations. For an electrophotographic imaging member such as a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be generally from about 20 angstroms to about 750 angstroms, and typically from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium, hafnium, titanium, nickel, stainless steel, chromium, tungsten, molybdenum, and the like. For example, a continuous metal film can be attained on a suitable substrate, e.g. a polyester web substrate such as MYLAR available from E. I. DuPont de Nemours & Co. with magnetron sputtering.

If desired, an alloy of suitable metals may be deposited. Typical metal alloys may contain two or more metals such as zirconium, niobium, tantalum, vanadium, hafnium, titanium, nickel, stainless steel, chromium, tungsten, molybdenum, and the like, and mixtures thereof. A typical electrical conductivity for conductive layers for electrophotographic imaging members in slow speed copiers is about $10^2$ to $10^3$ ohms/square.

The undercoat layer that is formed from the UCL formulation of the present disclosure may be applied to the substrate. The UCL may be applied by any suitable conventional technique such as spraying, dip coating, draw bar coating, gravure coating, silk screening, air knife coating, reverse roll coating, vacuum deposition, chemical treatment and the like. The UCL should be continuous and has a thickness of from about 0.5 micrometer to about 30 micrometer, because greater thicknesses may lead to undesirably high residual voltage.

Any suitable adhesive layer well known in the art may optionally be applied to the hole blocking layer or undercoat layer. Typical adhesive layer materials include, for example, polyesters, polyurethanes, and the like. Satisfactory results may be achieved with adhesive layer thickness from about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, hole blocking layer or substrate. The electrophotographic imaging layer may be a single layer that performs both charge generating and charge transport functions as is well known in the art or it may comprise multiple layers such as a charge generation layer and a charge transport layer.

Charge generation layers may comprise amorphous selenium, triggonal selenium, and alloys of selenium and arsenic, tellurium, germanium and the like, hydrogenated amorphous silicon and compounds of silicon and germanium, carbon, oxygen, nitrogen, and the like fabricated by, for example, vacuum evaporation or deposition. The charge generation layers may also comprise inorganic pigments of crystalline selenium and its alloys; Group II-VI compounds; and organic pigments and dyes such as quinacridones, polycyclic pigments such as dibromo anthanthrone pigments, perylene and perinone diamines, polynuclear aromatic quinones, azo pigments including bis-, tris- and tetrakis-azos; quinoline pigments, indigo pigments, thioindigo pigments, bisbenzimidazole pigments, phthalocyanine pigments, quinacridone pigments, lake pigments, azo lake pigments, oxazine pigments, dioxazine pigments, triphenylmethane pigments, azulenium dyes, squalium dyes, pyrylium dyes, triallylmethane dyes, xanthene dyes, thiazine dyes, cyanine dyes, and the like dispersed in a film-forming polymeric binder and fabricated by solvent coating techniques.

In an embodiment, phthalocyanines may be employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, for example, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, which have a strong influence on photogeneration.

Any suitable polymeric film-forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

A photogenerating composition or pigment may be present in the resinous binder composition in various amounts. Generally, however, from about 5 percent by volume to about 90 percent by volume of the photogenerating pigment is dispersed in about 10 percent by volume to about 95 percent by volume of the resinous binder, and typically from about 20 percent by volume to about 30 percent by volume of the photogenerating pigment is dispersed in about 70 percent by volume to about 80 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent-coated layer may be effected by any suitable conventional technique such as oven drying, infrared radiation drying, air drying and the like.

The charge transport layer may comprise a charge-transporting molecule, typically small molecule, dissolved or molecularly dispersed in a film forming electrically inert polymer such as a polycarbonate. The term "dissolved" is defined herein as forming a solution in which the molecules are dissolved in the polymer to form a homogeneous phase. The expression "molecularly dispersed" used herein is defined as a charge transporting small molecule dispersed in the polymer, the small molecules being dispersed in the polymer on a molecular scale.

Any suitable charge transporting or electrically active small molecule may be employed in the charge transport layer of this disclosure. The expression charge transporting "small molecule" is defined herein as a monomer that allows the free charge photogenerated in the generator layer to be transported across the transport layer.

Typical charge transporting molecules include, but are not limited to, pyrene, carbazole, hydrazone, oxazole, oxadiazole, pyrazoline, arylamine, arylmethane, benzidine, thiazole, stilbene and butadiene compounds; pyrazolines such as 1-phenyl-3-(4'-diethylaminostyryl)-5-(4'-diethylamino phenyl)pyrazoline; diamines such as N,N'-diphenyl-N,N'-bis(3-methylphenyl)-(1,1'-biphenyl)-4,4'-diamine; hydrazones such as N-phenyl-N-methyl-3-(9-ethyl)carbazyl hydrazone and 4-diethyl amino benzaldehyde-1,2-diphenyl hydrazone; oxadiazoles such as 2,5-bis (4-N,N'-diethylaminophenyl)-1,2,4-oxadiazole; poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane, and the like.

In an embodiment of the present disclosure, to avoid cycle-up in machines with high throughput, the charge transport layer may be substantially free (less than about two percent) of triphenyl methane. As indicated above, suitable electrically active small molecule charge transporting compounds are dissolved or molecularly dispersed in electrically inactive polymeric film forming materials. An exemplary small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)4,4'-diamine. If desired, the charge transport material in the charge transport layer may comprise a polymeric charge transport material or a combination of a small molecule charge transport material and a polymeric charge transport material.

In an embodiment, the charge transport layer may contain an active aromatic diamine molecule, which enables charge transport, dissolved or molecularly dispersed in a film forming binder. The charge transport layer is disclosed in U.S. Pat. No. 4,265,990, the entire disclosure of which is incorporated herein by reference.

Any suitable electrically inactive resin binder that is also insoluble in the solvent such as alcoholic solvent used to apply the optional overcoat layer may be employed in the charge transport layer. Typical inactive resin binders include polycarbonate resin, polyester, polyarylate, polyacrylate, polyether, polysulfone, and the like. Molecular weights can vary, for example, from about 20,000 to about 150,000. Exemplary binders include polycarbonates such as poly (4,4'-isopropylidene-iphenylene)carbonate (also referred to as bisphenol-A-polycarbonate); polycarbonate; poly (4,4'-cyclohexylidinediphenylene) carbonate (referred to as bisphenol-Z polycarbonate); poly (4,4'-isopropylidene-3,3'-dimethyl-diphenyl)carbonate (also referred to as bisphenol-C-polycarbonate); and the like.

Any suitable charge transporting polymer may also be utilized in the charge transporting layer of this disclosure. The charge transporting polymer should be insoluble in the solvent employed to apply the overcoat layer. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is from about 10 to about 50 micrometers, but thicknesses outside this range can also be used. A hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of a hole transport layer to the charge generator layers is typically maintained from about 2:1 to 200:1 and in some instances as great as 400:1. Typically, a charge transport layer is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Optionally, other layers may also be used such as conventional electrically-conductive ground strip along one edge of the belt or drum in contact with the conductive layer, blocking layer, adhesive layer or charge generation layer to facilitate connection of the electrically conductive layer of the photoreceptor to ground or to an electrical bias. Ground strips are well known and usually comprise conductive particles dispersed in a film forming binder.

Optionally, an overcoat layer (OCL) may also be utilized to improve resistance to abrasion. OCL has been shown to increase the mechanical life of an OPC by as much as 10-fold. The overcoat layer is well known in the art and may comprise thermoplastic organic polymers or inorganic polymers that are electrically insulating or slightly semi-conductive.

The thickness of the overcoat layer depends upon the abrasiveness of the charging (e.g., bias charging roll), cleaning (e.g., blade or web), development (e.g., brush), transfer (e.g., bias transfer roll), etc., in the electrophotographic imaging system employed. Generally, the overcoat layer thickness may range up to about 10 micrometers. A typical thickness is from about 1 micrometer to about 5 micrometers.

Any suitable and conventional technique may be utilized to mix and thereafter apply the overcoat layer coating mixture to the charge transport/generating layer. Typical application techniques include spraying, dip coating, roll coating, wire wound rod coating, and the like. Drying of the deposited coating may be effected by any suitable conventional technique such as oven drying, infrared radiation drying, air drying and the like.

The dried overcoat should transport holes during imaging and should not have too high free carrier concentration. Free carrier concentration in an overcoat increases the dark decay. It is desirable that the dark decay of the overcoated layer is about the same as, or is close to, that of an unovercoated counterpart.

According to the present disclosure, a method of imaging is provided. The imaging method comprises (i) generating an electrostatic latent image on an imaging member comprising the UCL as described supra, (ii) developing the latent image, and (ii) transferring the developed electrostatic image to a suitable substrate.

The imaging member such as photoreceptor according to. the present disclosure may be incorporated into various imaging systems such as those conventionally known as xerographic imaging devices or electrophotographic image forming devices. Additionally, the imaging members may be selected for imaging and printing systems with visible, near-red and/or infrared light. In this embodiment, the imaging members may be negatively or positively charged, exposed to light having a wavelength of from about 700 to about 900, such as generated by solid state layers, e.g., arsenide-type lasers, either sequentially or simultaneously, followed by developing the resulting image and transferring it to a print substrate such as transparency or paper. Additionally, the imaging members may be selected for imaging and printing systems with visible light. In this embodiment, the imaging members may be negatively or positively charged, exposed to light having a wavelength of from about 400 to about 700 nanometers, followed by development with a known toner, and then transferring and fixing of the image on a print substrate.

In an embodiment, an image forming device may comprise the imaging member as discussed above, a charging device, an electrostatic image forming station, an image developing station, and an image transfer station.

In an embodiment, the image forming device may be used to generate images with the photoreceptor disclosed herein. Generally, the imaging member may be first charged with a corona charging device such as a corotron, dicorotron, scorotron, pin charging device, bias charging roll (BCR) or the like. Then, an electrostatic image is generated on the imaging member with an electrostatic image forming device. Subsequently, the electrostatic image is developed by known developing devices at one or more developing stations that apply developer compositions such as, for example, compositions comprised of resin particles, pigment particles, additives including charge control agents and carrier particles, etc., reference being made to, for example, U.S. Pat. Nos. 4,558,108; 4,560,535; 3,590,000; 4,264,672; 3,900,588 and 3,849,182, the disclosures of each of these patents being totally incorporated herein by reference. The developed electrostatic image is then transferred to a suitable print substrate such as paper or transparency at an image transfer station, and affixed to the substrate. Development of the image may be achieved by a number of methods, such as cascade, touchdown, powder cloud, magnetic brush, and the like.

Transfer of the developed image to a print substrate may be by any suitable method, including those wherein a corotron or a biased roll is selected. The fixing step may be performed by means of any suitable method, such as flash fusing, heat fusing, pressure fusing, vapor fusing, and the like.

Following transfer of the developed image from the imaging member surface, the imaging member may be cleaned of any residual developer remaining on the surface, and also cleaned of any residual electrostatic charge prior to being subjected to charging for development of a further or next image.

Specific embodiments of the disclosure will now be described in detail. These examples are intended to be illustrative, and the disclosure is not limited to the materials, conditions, or process parameters set forth in these embodiments. All parts and percentages are by weight unless otherwise indicated.

EXAMPLE

Example 1

An UCL formulation consisting of TYZOR AA-105, γ-APS, and UCARMAG-527 with a weight ratio of 40/40/20 in methyl isobutyl ketone was prepared. The preparation of the UCL solution is addition with order: polymer in solvent first, then aminosilane, then organic titanate. A clear UCL solution is obtained from the above formulation.

Example 2

Similarly to Example 1, an UCL formulation consisting of TYZOR AA-105 and UCARMAG-527 (no γ-APS) with a weight ratio of 80/20 in methyl isobutyl ketone was prepared. Although TYZOR AA-105 tends to temporarily gel the UCARMAG-527 solution (no γ-APS), a clear solution was still obtained after overnight mixing.

Example 3

Similarly to Example 1, an UCL formulation consisting of γ-APS and UCARMAG-527 (no titanate) with a weight ratio of 80/20 in methyl isobutyl ketone was prepared.

Example 4

All the three solutions from Examples 1-3 were coated as UCLs with Tsukiage coater and cured at 160° C. for 15 minutes. Within thickness range (1-20 μm), TYZOR AA-105/UCARMAG-527=80/20 UCL tends to crack and thus no full device was made for this UCL. The other two gave very decent coatings, however, γ-APS/UCARMAG-527=80/20 UCL tends to dissolve in n-butyl acetate, the solvent used in the subsequent CG coating. No full device was made of this UCL either. The successful UCL was the UCL comprising titanate, aminosilane and UCARMAG-527. The UCL coating was solvent resistant, and the devices were prepared with this UCL at thickness of 3.0 μm, 10.0 μm. A 0.5 micron thick photogenerating layer was subsequently coated on top of the above generated undercoat layer from a dispersion of Type V hydroxygallium phthalocyanine (3.0 grams) and a vinyl chloride/vinyl acetate copolymer, VMCH ($M_n$=27,000, about 86 weight percent of vinyl chloride, about 13 weight percent of vinyl acetate and about 1 weight percent of maleic acid) available from Dow Chemical (2.0 grams), in 95 grams of n-butylacetate. Subsequently, a 24 μm thick charge transport layer (CTL) was coated on top of the photogenerating layer from a solution prepared from N,N'-diphenyl-N,N-bis(3-methylphenyl)-1,1'-biphenyl4,4'-diamine (5 grams) and a film forming polymer binder PCZ400 [poly(4,4'-dihydroxydiphenyl-1-1-cyclohexane, $M_w$=40,000)] available from Mitsubishi Gas Chemical Company, Ltd. (7.5 grams) dissolved in a solvent mixture of 20 grams of tetrahydrofuran (THF) and 6.7 grams of toluene. The CTL was dried at 120° C. for 40 minutes.

The above prepared two photoreceptor devices were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.).

The residual potentials for the two devices are 40V for the device with UCL thickness of 3.0 μm, and 45V for the device with UCL thickness of 10.0 μm. The photoinduced discharge characteristic curves appear to be independent of the UCL thickness.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An imaging member comprising an electrically conductive substrate or a substrate comprising an electrically conductive layer, an undercoat layer (UCL), a charge generation layer, a charge transport layer, and an optional overcoat layer; in which the undercoat layer is formed from a UCL formulation comprising an organic titanate, a polymer containing active hydrogen, and an aminosilane; when dissolved in a solvent, the UCL formulation and the solvent form a single phase; and wherein the polymer containing active hydrogen is poly(methyl methacrylate-co-2-hydroxyethyl methacrylate).

2. The imaging member according to claim 1, in which the solvent is selected from the group consisting of ketone solvent, ether solvent, alcohol solvent, nitrile solvent, ester solvent, carbonate solvent, halogenated hydrocarbon solvent, hydrocarbon solvent, and the mixture thereof.

3. The imaging member according to claim 1, in which the solvent comprises a ketone solvent.

4. The imaging member according to claim 3, in which the ketone solvent is selected from the group consisting of methyl isobutyl ketone (MIBK), methyl ethyl ketone (MEK), acetone, methyl propyl ketone, methyl isopropyl ketone, methyl butyl ketone, methyl amyl ketone, methyl isoamyl ketone, diethyl ketone, ethyl amyl ketone, dipropyl ketone, diisopropyl ketone, cyclohexanone, methylcylcohexanone, trimethylcyclohexanone, mesityl oxide, diisobutyl ketone, isophorone, and the mixture thereof.

5. The imaging member according to claim 3, in which the ketone solvent comprises methyl isobutyl ketone (MIBK) or methyl ethyl ketone (MEK).

6. The imaging member according to claim 1, in which the organic titanate comprises a chelated titanate.

7. The imaging member according to claim 1, in which the organic titanate comprises a titanium acetylacetonate or a triethanolamine titanate.

8. The imaging member according to claim 1, in which the organic titanate comprises a compound selected from the group consisting of (T1)

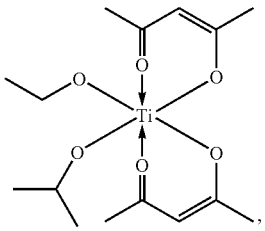

(T2)

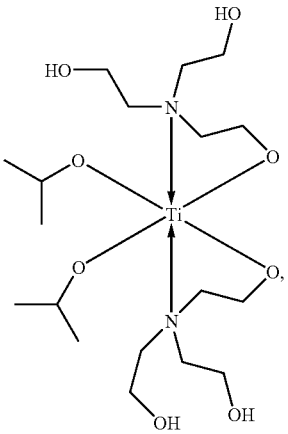

-continued
(T3)
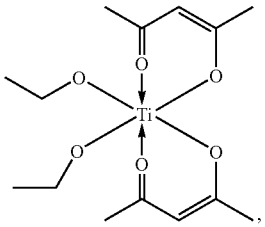
(T4)
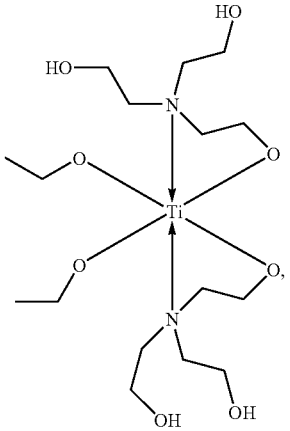
(T5)
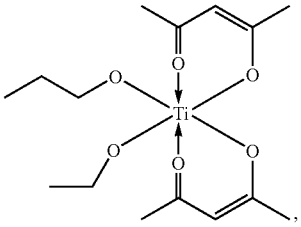
(T6)
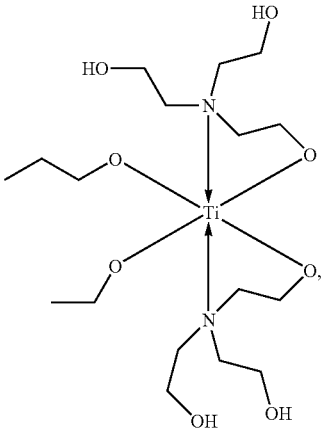
(T7)
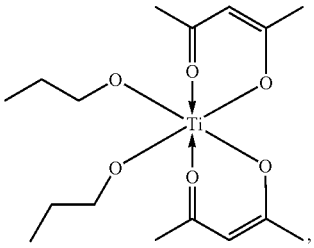
-continued
(T8)
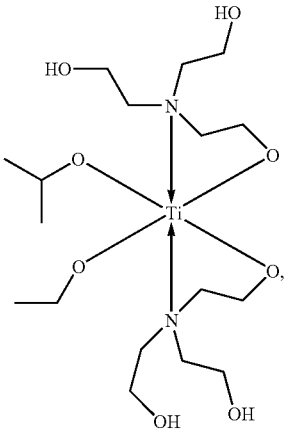
(T9)
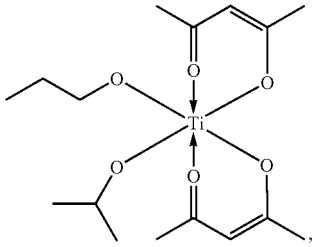
(T10)
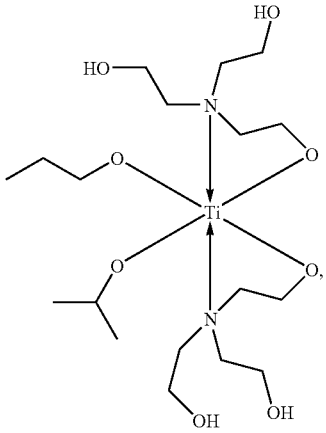
(T11)
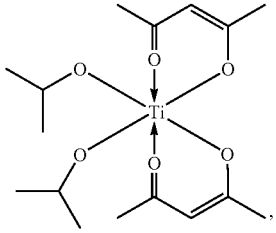

-continued
(T12)
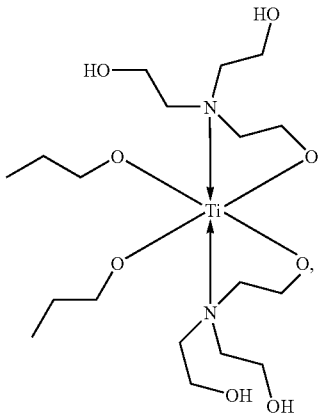
(T13)
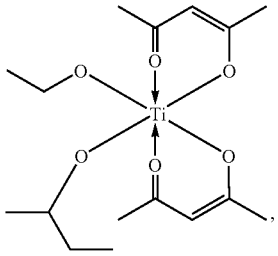
(T14)
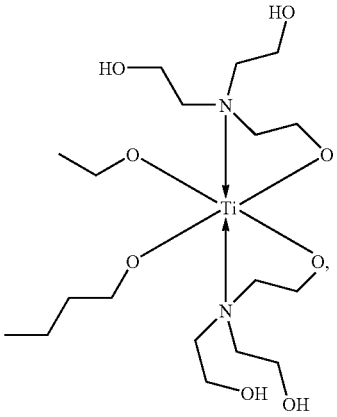
(T15)
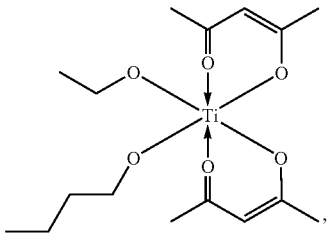
-continued
(T16)
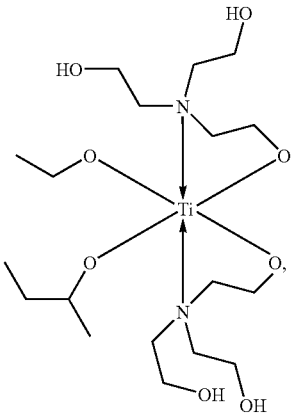
(T17)
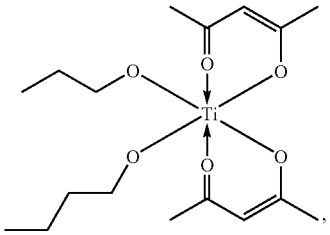
(T18)
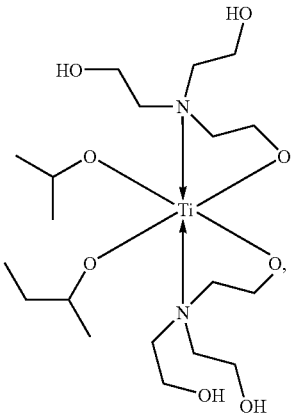
(T19)
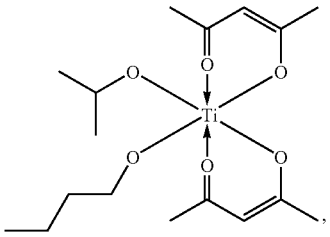

-continued (T20)

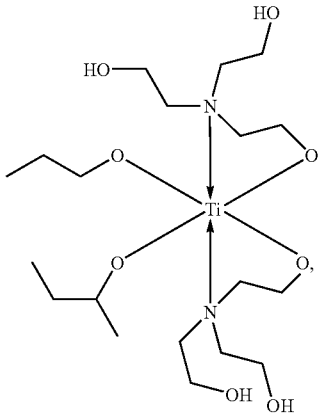

(T21)

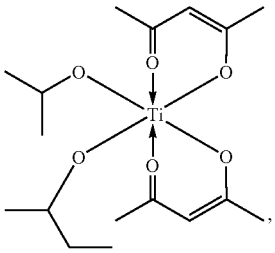

(T22)

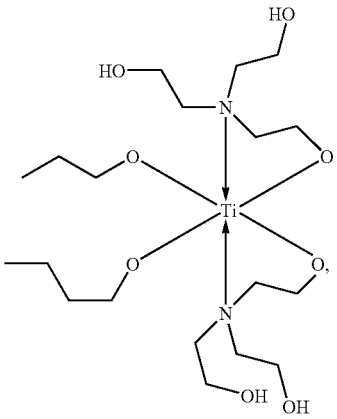

(T23)

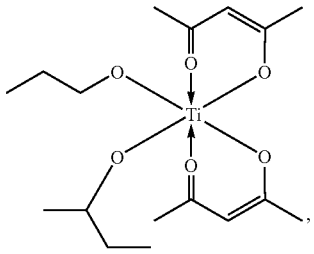

-continued (T24)

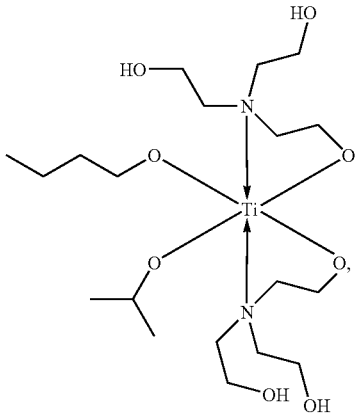

and the mixture thereof.

9. The imaging member according to claim 1, in which the amount of the organic titanate present in the UCL formulation is from about 5 to about 80 wt %, based on the total weight of the UCL formulation.

10. The imaging member according to claim 1, in which the amount of the polymer containing active hydrogen present in the UCL formulation is from about 1 to about 50 wt %, based on the total weight of the UCL formulation.

11. The imaging member according to claim 1, in which the aminosilane is selected from one or more of the following compounds:

G-1

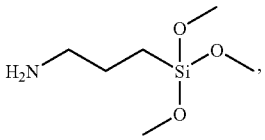

G-2

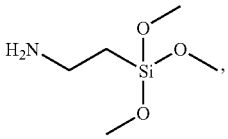

G-3

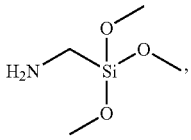

G-4

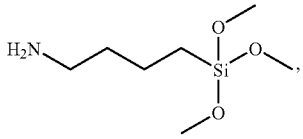

G-5

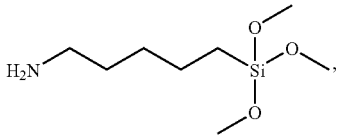

-continued

G-6

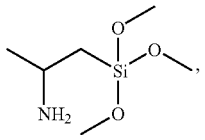

G-7

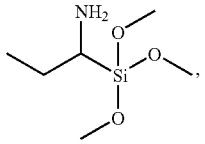

G-8

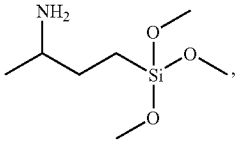

G-9

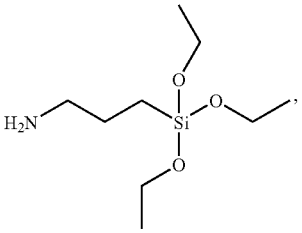

G-10

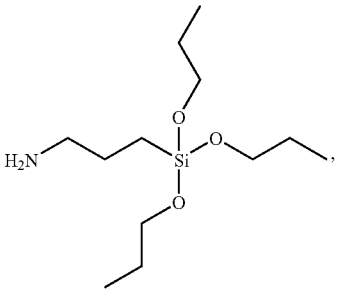

G-11

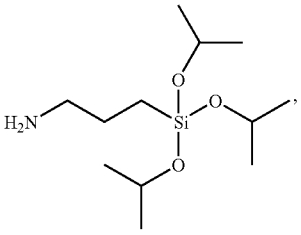

G-12

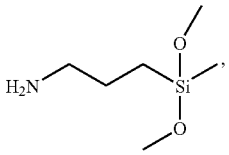

G-13

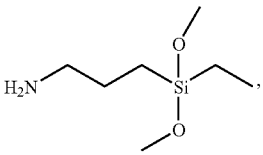

-continued

G-14

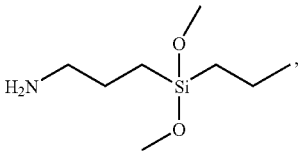

G-15

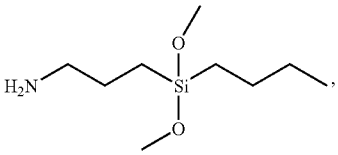

G-16

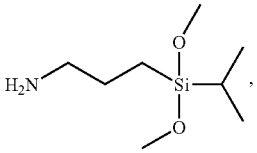

G-17

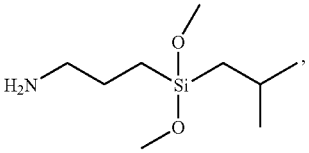

G-18

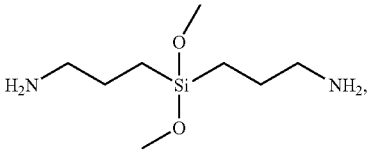

G-19

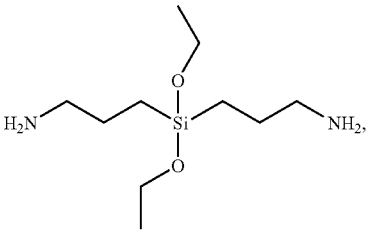

and the mixture thereof.

12. The imaging member according to claim 1, in which the amount of the aminosilane present in the UCL formulation is from about 5 to about 80 wt %, based on the total weight of the UCL formulation.

13. The imaging member according to claim 1, which is a photoreceptor.

14. A method of preparing an imaging member, which comprises (i) providing an electrically conductive substrate or a substrate comprising an electrically conductive layer, (ii) coating an undercoat layer (UCL) above the substrate, (iii) coating a charge generation layer (CGL) above the UCL, (iv) coating a charge transport layer (CTL) above the CGL, and (v) optionally coating an overcoat layer (OCL) above the CTL;

in which the undercoat layer is formed from a UCL formulation comprising an organic titanate, a polymer containing active hydrogen, and an aminosilane;

when dissolved in a solvent, the UCL formulation and the solvent form a single phase solution; and wherein the polymer containing active hydrogen is poly (methyl methacrylate-co-2-hydroxyethyl methacrylate).

15. A method of imaging which comprises (i) generating an electrostatic latent image on the imaging member of claim 1, (ii) developing the latent image, and (iii) transferring the developed electrostatic image to a print substrate selected from the group consisting of a transparency and paper.

16. An imaging member comprising an electrically conductive substrate or a substrate comprising an electrically conductive layer, an undercoat layer (UCL), a charge generation layer, a charge transport layer, and an optional overcoat layer; in which the undercoat layer is formed from a UCL formulation comprising an organic titanate, a polymer containing active hydrogen, and an aminosilane; when dissolved in a solvent, the UCL formulation and the solvent form a single phase; wherein the polymer containing active hydrogen is selected from the group consisting of (i) a terpolymer represented by the following formula:

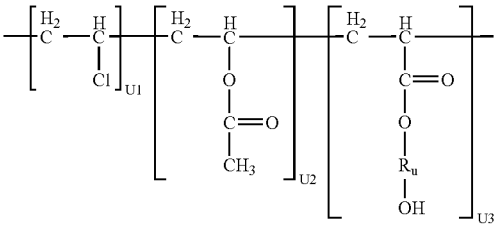

wherein $R_u$ is an alkylene group such as ethylene or propylene; U1 is the vinyl chloride proportion that is from about 80% to about 90% by weight, U2 is the vinyl acetate proportion that is from about 3% to about 15% by weight, U3 is the hydroxyalkyl acrylate proportion that is from about 6% and about 20% by weight, based on the total weight of the terpolymer, (ii) a tetrapolymer represented by the following formula:

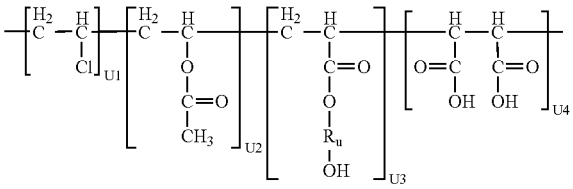

wherein $R_u$ is an alkylene group such as ethylene or propylene; U1 is the vinyl chloride proportion that is from about 80% to about 90% by weight, U2 is the vinyl acetate proportion that is from about 3% to about 15% by weight, U3 is the hydroxyalkyl acrylate proportion that is from about 6% to about 20% by weight, U4 is the maleic acid proportion that is from about 0.1% to about 0.5% by weight, based on the total weight of the tetrapolymer, and (iii) a poly(methyl methacrylate-co-2-hydroxyethyl methacrylate); and wherein the organic titanate comprises a chelated titanate, a titanium acetylacetonate, a triethanolamine titanate, or a compound selected from the group consisting of (T1)

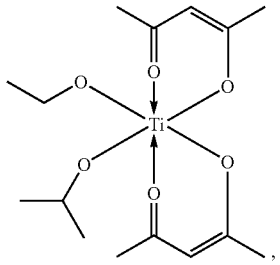

(T2)

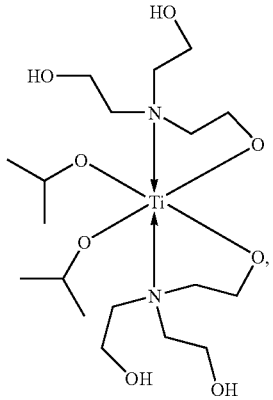

(T3)

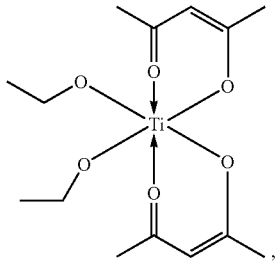

(T4)

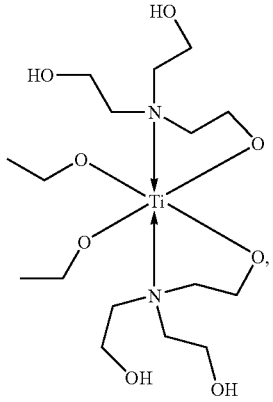

(T5)

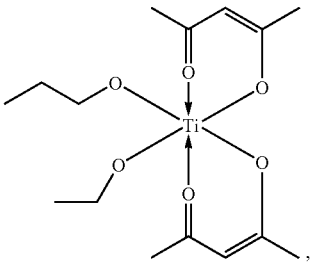

-continued
(T6)
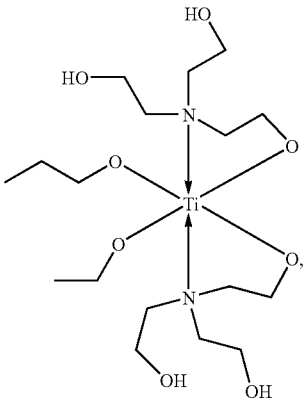
(T7)
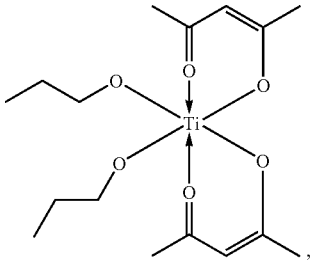
(T8)
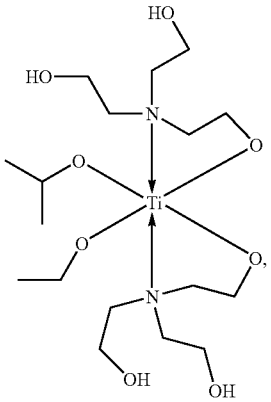
(T9)
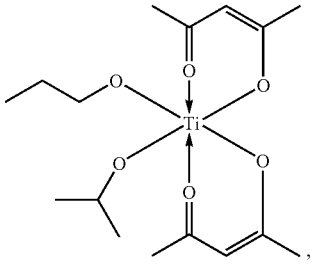
-continued
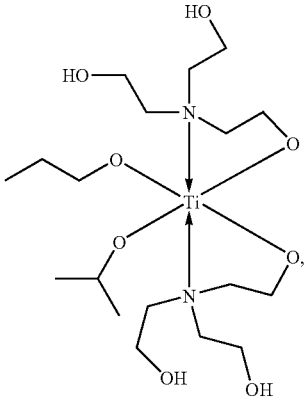
(T11)
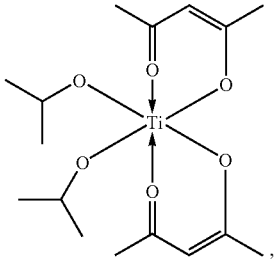
(T12)
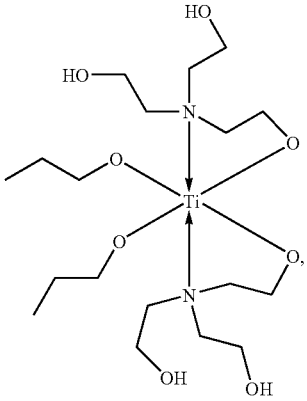
(T13)
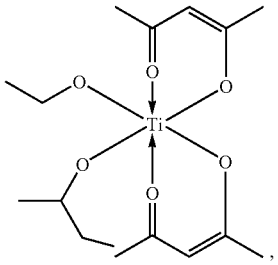

-continued
(T14)
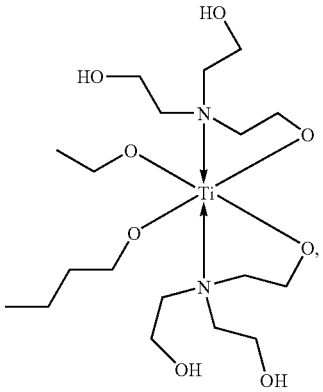
(T15)
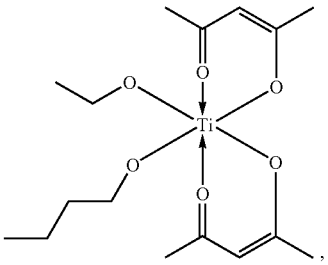
(T16)
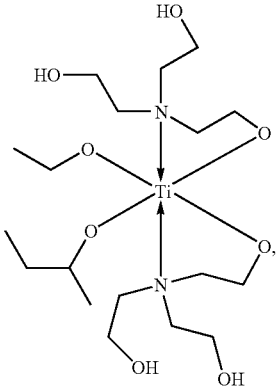
(T17)
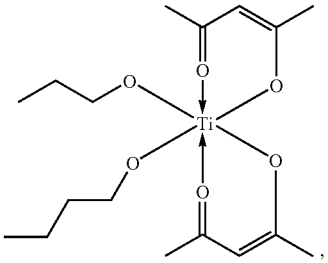
-continued
(T18)
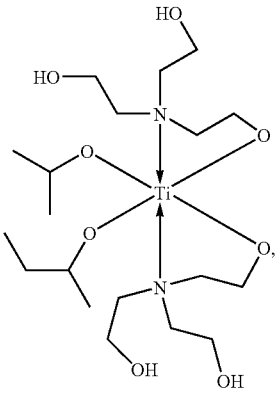
(T19)
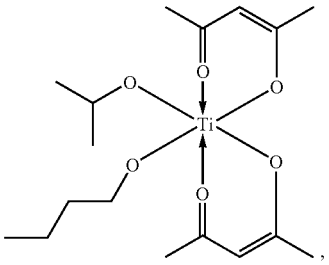
(T20)
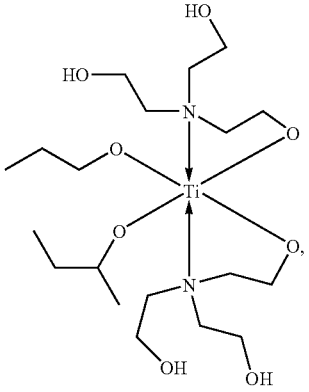
(t21)
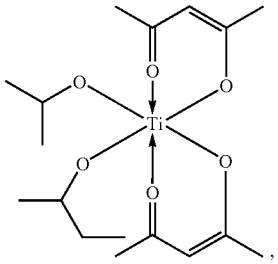

-continued
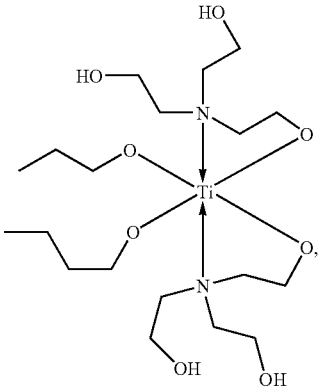
(t23)
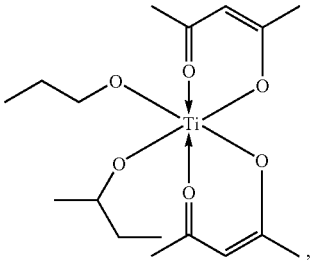
,
-continued
(t24)
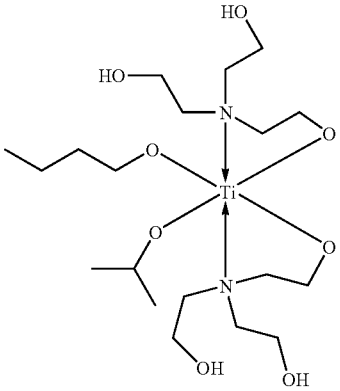
, and the mixture thereof.
* * * * *